US007302938B2

(12) United States Patent
Yu et al.

(10) Patent No.: US 7,302,938 B2
(45) Date of Patent: Dec. 4, 2007

(54) MECHANICAL RETURNLESS FUEL SYSTEM

(75) Inventors: DeQuan Yu, Ann Harbor, MI (US); Stephen T. Kempfer, Canton, MI (US)

(73) Assignee: Ford Motor Company, Dearborn, MI (US)

( * ) Notice: Subject to any disclaimer, the term of this patent is extended or adjusted under 35 U.S.C. 154(b) by 0 days.

(21) Appl. No.: 10/687,385

(22) Filed: Oct. 16, 2003

(65) Prior Publication Data

US 2005/0081826 A1 Apr. 21, 2005

(51) Int. Cl.
*F02M 37/04* (2006.01)

(52) U.S. Cl. ..... 123/514; 123/497

(58) Field of Classification Search ..... 123/456, 123/497, 499, 514, 357, 506, 457, 463
See application file for complete search history.

(56) References Cited

U.S. PATENT DOCUMENTS

| | | | | | |
|---|---|---|---|---|---|
| 121,659 | A | | 12/1871 | Prescott | |
| 1,676,666 | A | | 7/1928 | Pivoto | |
| 1,767,538 | A | | 6/1930 | Mahan | |
| 2,660,246 | A | | 11/1953 | Otis et al. | |
| 2,909,192 | A | | 10/1959 | Dobrick | |
| 4,936,342 | A | * | 6/1990 | Kojima et al. | 137/510 |
| 4,964,391 | A | | 10/1990 | Hoover | |
| 5,085,193 | A | * | 2/1992 | Morikawa | 123/458 |
| 5,163,472 | A | * | 11/1992 | Takada et al. | 137/507 |
| 5,193,576 | A | * | 3/1993 | Mosby | 137/510 |
| 5,560,343 | A | | 10/1996 | Werkmann et al. | |
| 5,623,910 | A | | 4/1997 | Riggle | |
| 5,639,229 | A | | 6/1997 | Cooke | |
| 5,669,356 | A | | 9/1997 | Wall et al. | |
| 5,673,670 | A | * | 10/1997 | Powell et al. | 123/463 |
| 5,692,479 | A | | 12/1997 | Ford et al. | |
| 5,715,797 | A | * | 2/1998 | Minagawa et al. | 123/497 |
| 5,842,455 | A | | 12/1998 | Tuckey et al. | |
| 6,109,243 | A | | 8/2000 | Seyerle | |
| 6,152,171 | A | | 11/2000 | Messick et al. | |
| 6,253,740 | B1 | | 7/2001 | Rembold | |
| 6,367,455 | B2 | * | 4/2002 | Hirata et al. | 123/497 |
| 6,497,247 | B1 | | 12/2002 | Kinoshita et al. | |
| 6,520,163 | B2 | | 2/2003 | Yoshioka et al. | |
| 6,532,941 | B2 | | 3/2003 | Begley et al. | |
| 6,701,905 | B1 | * | 3/2004 | Gaskins | 123/674 |
| 2001/0025639 | A1 | | 10/2001 | Kiowsky et al. | |
| 2002/0026927 | A1 | | 3/2002 | Yoshioka et al. | |
| 2002/0096147 | A1 | | 7/2002 | Muhlhausen | |

* cited by examiner

*Primary Examiner*—Carl S. Miller
(74) *Attorney, Agent, or Firm*—Greg Brown; MacMillan, Sobanski & Todd LLC

(57) ABSTRACT

A mechanical returnless fuel system comprises a fuel pump having an output for supplying fuel to fuel injectors of an automotive engine. The fuel system includes a pressure regulating valve that returns a portion of the pump output in excess of engine fuel usage to the fuel supply. The pressure regulating valve results in a fuel pressure that varies as a function of engine fuel demand. During operation, a controller determines a projected engine fuel demand, then determines an estimated fuel pressure based upon the projected engine fuel demand. The controller utilizes the estimated fuel pressure to provide a more accurate calculation of the opening time for the fuel injectors and thereby improve engine control.

6 Claims, 1 Drawing Sheet

MECHANICAL RETURNLESS FUEL SYSTEM

TECHNICAL FIELD OF THE INVENTION

This invention relates to a mechanical returnless fuel system for an automotive engine that utilizes fuel pressure in determining fuel injector opening time. More particularly, this invention relates to such system wherein the fuel pressure is determined based upon engine fuel demand.

BACKGROUND OF THE INVENTION

In a modern automotive vehicle, the engine is equipped with fuel injectors that spray precise quantities of fuel into the air stream flowing through a manifold to the combustion chambers. The fuel is distributed to the injectors through a fuel rail mounted on the engine. A computer controller calculates the precise quantity of fuel and the opening time required by the fuel injector to release the precise quantity. The opening time is dependent upon the pressure drop across the injector, that is, the difference in pressure between the fuel pressure within the fuel rail and the air pressure within the manifold. The typical fuel system comprises a fuel pump located within a fuel tank and connected to the fuel rail through a fuel line. In an electronic returnless fuel system, a sensor is mounted in the fuel line or the fuel rail and provides an electrical signal to the controller that is indicative of fuel pressure. The controller utilizes the pressure signal in regulating the duty cycle of the fuel pump to maintain a desired fuel pressure. As a result, the system provides a predetermined fuel pressure for purposes of calculating the injector pressure drop.

Mechanical returnless fuel systems are known that include a pressure regulator coupled to the fuel line. The regulator opens to discharge fuel to the fuel supply to thereby relieve excess pressure within the fuel line. In a conventional mechanical returnless fuel system, the pressure regulator comprises a diaphragm biased by a spring and designed to maintain a substantially constant fuel pressure over a range of fuel flow rates typical of engine operation. As a result, the diaphragm regulator provides a constant fuel pressure that is relied upon by the controller for purposes of calculating the pressure drop across the injectors and thus the injector opening time. However, the diaphragm regulator requires a complex design and adds significantly to the cost of the system.

U.S. Pat. No. 6,953,026 issued Oct. 11, 2005 describes a pressure regulating valve for use in a mechanical returnless fuel system. Valve is a relatively less expensive design and produces a fuel pressure that is not constant, but rather is linearly proportional to the fuel flow rate.

Therefore, a need exists for a mechanical returnless fuel system wherein fuel pressure in the fuel line is subject to variation, and wherein the controller is able to determine a fuel pressure based upon pump operating conditions and without requiring an in-line fuel pressure sensor.

SUMMARY OF THE INVENTION

In accordance with this invention, a method is provided for operating an automotive engine that includes fuel injectors that open intermittently to deliver fuel to the automotive engine. A mechanical returnless fuel system supplies fuel to the fuel injectors and includes a fuel pump having a pump output. A portion of the pump output in excess of engine fuel usage is returned to the fuel supply. A controller is provided for regulating the fuel injectors to deliver a quantity of fuel. In accordance with this invention, the controller determines a projected engine fuel demand then determines an estimated fuel pressure based upon the projected engine fuel demand, and then determines an opening time for the fuel injectors based upon the estimated fuel pressure. In a system wherein fuel pressure is not constant, but rather varies in proportion to engine fuel flow rate, the estimated fuel pressure provides a more accurate basis for determining the opening time for the fuel injectors and thus provides improved control of the automotive engine operation. Moreover, this is accomplished without requiring a fuel pressure sensor and related connection to the controller.

In one aspect of this invention, a combination is provided that includes an automotive engine, a mechanical returnless fuel system and a controller which cooperate to improve engine operations. The automotive engine includes fuel injectors that are intermittently open for an opening time to deliver fuel to the engine. Fuel is supplied to the fuel injectors by a mechanical returnless fuel system that includes a fuel pump having a pump output and a fuel line connecting the fuel pump to the injectors. A pressure regulating valve is provided for returning a excess portion of the pump output to the fuel supply. The controller regulates the injectors by determining a projected engine fuel demand, then determining an estimated fuel pressure based upon the projected engine fuel demand and then determining the opening time of the injectors based upon the estimated fuel pressure. Using the estimated fuel pressure, the controller is able to more accurately calculate the opening time for the fuel injectors and thereby improve control of engine operation.

BRIEF DESCRIPTION OF THE DRAWINGS

This invention will be further illustrated with reference to the accompanying drawings wherein.

DETAILED DESCRIPTION OF THE INVENTION

Figure 1:
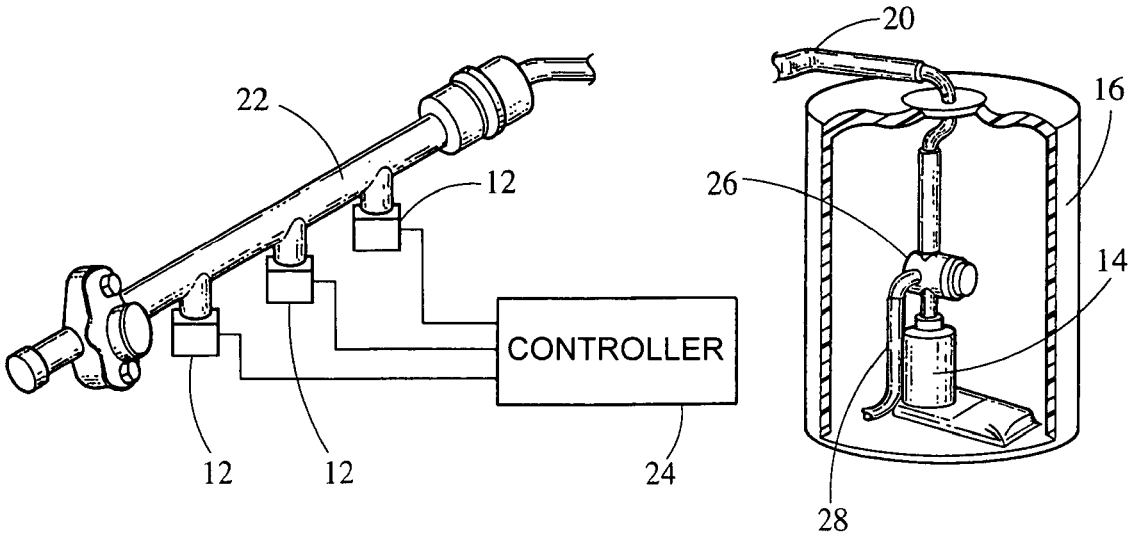
FIG. 1 is a schematic view showing a mechanical returnless fuel system in accordance with this invention.

Referring to FIG. 1, there is depicted a mechanical retunless fuel system 10 for supplying fuel to an automotive engine in accordance with a preferred embodiment of the invention. More particularly, system 10 delivers fuel to fuel injectors 12 that are mounted on the automotive engine. Injectors 12 open intermittently to spray fuel into an air stream flowing through an air manifold in route to combustion chambers of the engine. Fuel system 10 comprises a fuel pump 14 located within a fuel tank 16 with a pump outout that is substantially constant. The outlet from fuel pump 14 is connected to injectors 12 through a fuel line 20 that includes a fuel rail 22 mounted on the engine. A computer controller 24 is connected to fuel injectors 12 and regulates the opening of the fuel injectors to deliver a precise quantity of fuel for engine operation.

Figure 2:
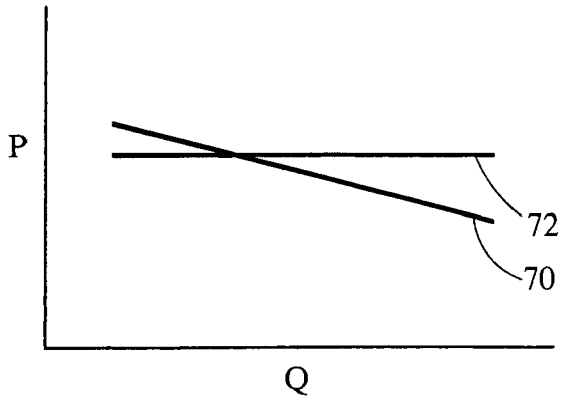
FIG. 2 is a graph showing fuel pressure as a function of engine fuel flow rate.

Fuel system 10 also includes a pressure regulating valve 22 that is coupled to fuel line 20 within tank 16 and returns a portion of the pumped fuel to the fuel supply through return line 28. A preferred pressure regulating valve is described in U.S. Pat. No. 6,953,026 issued Oct. 11, 2005, incorporated herein by reference. The preferred valve comprises a frustoconical valve body that is biased by a coil spring against a valve seat in the dosed position. The valve body slides in response to increased fuel pressure within the fuel dine to contract the coil spring and space the valve body apart from the valve seat, thereby opening the valve for fluid flow through return line 28. It is a feature that the pressure regulating valve produces a fuel pressure in fuel line 20 that varies as a function of fuel flow to the engine. Referring to FIG. 2, there is depicted a graph showing fuel pressure P in the fuel line as a function of engine fuel flow rate Q. The engine fuel flow rate Q corresponds to the engine fuel usage, which is also referred to as actual engine fuel demand, and is equal to the output of fuel pump 14 minus the portion of fuel returned to the fuel supply through pressure regulating valve 26. Line 70 shows a relationship wherein fuel line pressure P increases in direct proportion to engine fuel flow rate Q which may be provided by a pressure regulating valve suitable for use with this invention. For purposes of comparison, line 72 represents an idealized situation that provides a substantially constant pressure independent of fuel flow rate, such as is provided by a diaphragm-type pressure regulator in a conventional mechanical returnless fuel system. Thus, there is a significant discrepancy between the actual fuel line pressure as shown for line 70, and a theoretical constant pressure, such as might be provided by line 70, particularly at relatively low or high fuel flow rates. As a result, a controller calculating injector opening times based upon an arbitrary constant fuel pressure may calculate an opening time that delivers a quantity of fuel that deviates significantly from the desired controlled quantity.

In a preferred method of this invention, controller 24 determines a precise quantity of fuel required for optimum engine operation based upon engine operating parameters including vehicle speed, engine speed, and engine load, which is referred to herein as the projected engine fuel demand. The controller then calculates an opening time for the fuel injectors required to deliver the precise fuel quantity. The controller calculates the opening time based upon the pressure differential between fuel in fuel rail 22 and the air stream into which the fuel is injected, that is, the air stream flowing through the manifold in route to the combustion chambers of the engine. The controller regulates opening of injectors 12 to achieve the calculated opening time. It will be appreciated that controllers are known that include algorithms for suitably calculating projected engine fuel demand and injector opening times, and that such systems may be readily adapted for use with this invention. In accordance with the method of this invention, the controller determines an estimated fuel pressure based upon the projected engine fuel demand. It is pointed out that the projected engine fuel demand provides an accurate estimate of engine fuel usage within the tolerances required for modern engine control and that the mechanical returnless fuel system provides an engine fuel flow rate Q equal to the engine fuel usage. In a preferred embodiment, controller 24 includes a look-up table that correlates engine fuel flow rate with fuel pressure in accordance with the relationship such as shown in FIG. 2 and uses the projected engine fuel demand as the fuel flow rate to determine the estimated fuel pressure. The controller then determines the injector opening time based upon the estimated fuel pressure. Alternately, the controller may utilize an algorithm for calculating an estimated fuel pressure based upon the projected engine fuel demand. In any event, the controller utilizes the estimated fuel pressure to calculate the pressure drop across the injectors and thereby determine the opening time for the injectors. By utilizing an estimated fuel pressure determined in accordance with this invention, the controller is able to provide a more accurate estimate of the opening time for the injectors and thus provide better control of engine operations.

In the described embodiment, FIG. 2 depicts a substantially linear relationship between fuel pressure P and engine fuel flow rate Q. The fuel pressure within the system is dependent upon the particular design of the pressure regulating valve, and the method of this invention may be suitably carried out using a pressure regulating valve that produces a non-linear relationship. It is preferred that the data for the estimated fuel pressure represents the fuel pressure within the fuel rail adjacent the injectors. The fuel line may include fuel filters and connections that result in a pressure drop between the fuel pump and the fuel rail. The data for the estimated pressure may be obtained using measurements near the pump outlet and corrected as necessary for any pressure drop in the fuel line to the fuel rail.

While this invention has been described in terms of certain embodiments thereof, it is not intended to be so limited, but rather only to the extent set forth in the claims that follow.

The invention claimed is:

1. A method for operating an automotive engine comprising fuel injectors that open to deliver fuel to the engine, said method comprising:

providing a mechanical returnless fuel system for supplying fuel to the fuel injectors and including a fuel pump having a pump output, wherein the pump output is substantially constant;

providing a controller for regulating an opening time for the fuel injectors to deliver a precise quantity of fuel;

providing a diaphragm-less regulating valve disposed within a fuel tank for returning a portion of said pump output to the fuel supply, said diaphragm-less regulating valve outputting a non-constant linear output pressure to said fuel injectors;

determining a projected engine fuel demand, said pressure regulating valve producing a fuel pressure that varies as a function of engine fuel demand;

determining an estimated fuel pressure of said mechanical returnless fuel system in response to the projected engine fuel demand, said projected engine fuel demand correlating to a fuel flowrate, said determination of an estimated fuel pressure is based on a fuel pressure-fuel flow rate relationship where said fuel pressure varies linearly with said fuel flow rate; and determining an opening time for said fuel injectors based upon the estimated fuel pressure.

2. The method of claim 1 wherein the step of determining an estimated fuel pressure based off of said fuel pressure/fuel flow rate relationship comprises using a look-up table.

3. The method of claim 1 wherein the automotive engine comprises a fuel rail for distributing fuel to said injectors, and wherein the estimated fuel pressure corresponds to the fuel pressure within the fuel rail.

4. In combination, an automotive engine comprising fuel injectors that open for an opening time for delivering fuel to said engine;

a mechanical returnless fuel system for supplying fuel to said fuel injectors from a fuel supply, said mechanical returnless fuel system comprising a fuel pump having a pump output, a fuel line connecting the fuel pump to the fuel injectors and a diaphragm-less pressure regulating valve disposed within a fuel tank for returning a portion of the pump output to the fuel supply, wherein the pump output is substantially constant; and a controller for regulating the fuel injectors, wherein the controller determines a projected engine fuel demand, determines an estimated fuel pressure based upon the projected engine fuel demand, and determines the opening time of the fuel injectors based upon the estimated fuel pressure;

wherein the pressure regulating valve produces a fuel pressure in said fuel line that varies based u on actual en me fuel demand.

5. In combination according to claim 4 wherein the controller comprises a look-up table for determining estimated fuel pressure.

6. In combination according to claim 4 wherein the fuel line includes a fuel rail, and wherein the estimated fuel pressure corresponds to the fuel pressure of fuel within said fuel rail.

* * * * *